US006686574B2

(12) United States Patent
Hyun

(10) Patent No.: US 6,686,574 B2
(45) Date of Patent: Feb. 3, 2004

(54) MICROWAVE OVEN HAVING TWO DOORS

(75) Inventor: Jong-Hak Hyun, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/281,235

(22) Filed: Oct. 28, 2002

(65) Prior Publication Data

US 2004/0000544 A1 Jan. 1, 2004

(30) Foreign Application Priority Data

Jun. 29, 2002 (KR) ..... 2002-37608

(51) Int. Cl.[7] ..... H05B 6/76

(52) U.S. Cl. ..... 219/739; 219/740; 219/756; 126/190; 174/35 R

(58) Field of Search ..... 219/739, 740, 219/741, 756, 391; 126/190, 198, 200; 174/35 R

(56) References Cited

U.S. PATENT DOCUMENTS 3,177,335 A * 4/1965 Fitzmayer et al. ..... 219/685
4,039,775 A * 8/1977 Andra ..... 219/385
5,022,380 A 6/1991 Faurel et al. ..... 126/190
6,072,169 A * 6/2000 Kang et al. ..... 219/702
6,271,502 B1 * 8/2001 Lee ..... 219/391

FOREIGN PATENT DOCUMENTS

DE 41 22 847 * 1/1993 ..... 126/273 R
JP 7-198572 * 8/1995

* cited by examiner

*Primary Examiner*—Philip H. Leung
(74) *Attorney, Agent, or Firm*—Staas & Halsey LLP

(57) ABSTRACT

A microwave oven includes two doors which primarily and secondarily prevent a leakage of microwaves from a cooking cavity during a cooking operation. A first door is rotatably hinged to a front wall of a cabinet of the microwave oven, so as to open and close an opening of the cooking cavity and primarily prevent the leakage of the microwaves from the cooking cavity. A second door is rotatably mounted to the cabinet in front of the first door to cover and uncover the front of the first door. The second door thus secondarily intercepts the microwaves which have leaked from the cooking cavity through a gap between the first door and the cabinet. The microwave oven effectively prevents almost all leakage of the microwaves from the cooking cavity during the cooking operation.

20 Claims, 3 Drawing Sheets

MICROWAVE OVEN HAVING TWO DOORS

CROSS-REFERENCE TO RELATED APPLICATIONS

This application claims the benefit of Korean Application No. 2002-37608, filed Jun. 29, 2002, in the Korean Intellectual Property Office, the disclosure of which is incorporated herein by reference.

BACKGROUND OF THE INVENTION

1. Field of the Invention

The present invention relates to microwave ovens, and more particularly, to a door provided on a microwave oven for closing or opening a cooking cavity of the microwave oven.

2. Description of the Related Art

Generally, a microwave oven is an electrically operated oven having a magnetron which generates high-frequency electromagnetic waves ("microwaves") with a fundamental frequency of 2450 MHz. The microwaves generated by the magnetron are radiated into a cooking cavity to repeatedly change a molecular arrangement of moisture existing in food, thus generating an intermolecular frictional heat within the food to cook the food.

FIG. 1 shows a conventional microwave oven having a cabinet 1 which establishes an outer appearance of the microwave oven. The cabinet 1 includes a cooking cavity 2 and a machine room (not shown) which are partitioned from each other. The cooking cavity 2 receives food to be cooked, while the machine room contains a variety of electrical and electronic devices, such as a magnetron (not shown) and a high voltage transformer (not shown).

When the microwave oven is turned on, the magnetron generates microwaves which are radiated into the cooking cavity 2 to cook the food laid in the cooking cavity 2.

The cooking cavity 2 of the microwave oven is opened at a front thereof to allow a user to place and remove the food from the cooking cavity 2. A door 3 is hinged to the cabinet 1 to close or open the cooking cavity 2.

The door 3 is designed such that the door 3 comes into a close contact with a front wall of the cabinet 1 so as to prevent a leakage of the microwaves from the cooking cavity 2 through a junction of the cabinet 1 and the door 3.

However, with use over a period of time, the door 3 may become deformed and an undesired gap may form at the junction of the cabinet 1 and the door 3. In such a case, the microwaves undesirably leak from the cooking cavity 2 through the gap.

SUMMARY OF THE INVENTION

Accordingly, it is an aspect of the present invention to provide a microwave oven which effectively prevents a leakage of microwaves from a cooking cavity through a junction of a cabinet and a door of the microwave oven.

Additional aspects and advantages of the invention will be set forth in part in the description which follows and, in part, will be obvious from the description, or may be learned by practice of the invention.

To achieve the above and other aspects of the present invention, there is provided a microwave oven comprising a heating unit to cook food, a cabinet which establishes an appearance of the oven, and a cooking cavity which is defined in the cabinet and includes an opening at a front thereof, wherein the cabinet includes a first door which opens and closes the opening of the cooking cavity, and a second door which is installed in front of the first door and covers and uncovers the front of the first door.

The first door may rotatably be hinged to a side edge of the cabinet so as to rotate left and right to open and close the opening of the cooking cavity, and the second door may be rotatable upward and downward to cover and uncover the front of the first door.

The second door may comprise an upper door part hinged to an upper portion of the cabinet, and a lower door part hinged to a lower portion of the cabinet, wherein the upper and lower door parts of the second door are fitted together or separated from each other to cover or uncover the front of the first door.

The cabinet may further include a projecting base which projects from a lower portion of the cabinet. The upper door part of the second door may cover both a top portion of the first door and an upper portion of the front of the cooking cavity, and the lower door part of the second door may be hinged to the projecting base of the cabinet.

The second door may be wider than the first door by a predetermined width, and may be curved in a vertical direction with respect to a base of the cabinet to cover both a front portion and an upper portion of the first door.

BRIEF DESCRIPTION OF THE DRAWINGS

The above aspects and advantages of the present invention will become more apparent by describing in detail a preferred embodiment thereof with reference to the accompanying drawings in which.

DETAILED DESCRIPTION OF THE PREFERRED EMBODIMENTS

Figure 1:
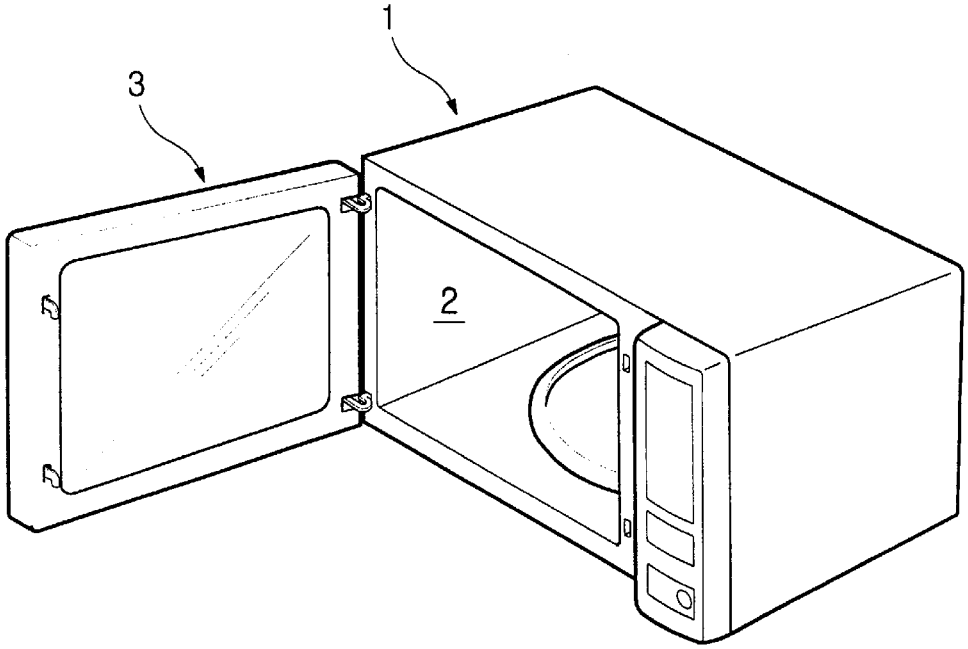
FIG. 1 (PRIOR ART)
FIG. 1 is a perspective view of a conventional microwave oven.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
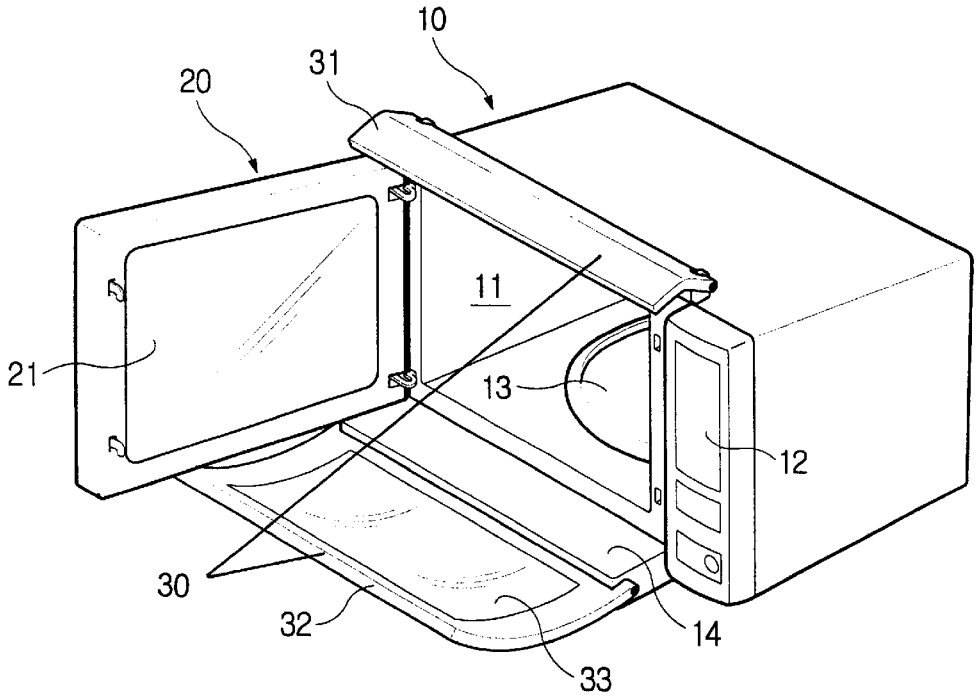
FIG. 2 is a perspective view of a microwave oven according to an embodiment of the present invention.

FIG. 2 shows a microwave oven according to an embodiment of the present invention. The microwave oven comprises a cabinet 10 which establishes an outer appearance of the microwave oven, and includes a cooking cavity 11 and a machine room (not shown) which are partitioned from each other. The cooking cavity 11 receives food to be cooked, and the machine room includes a variety of electrical and electronic devices, such as a magnetron (not shown), a high-tension transformer (not shown), and a cooling fan (not shown).

In the cabinet 10, the machine room is defined at one side of the cooking cavity 11 so as to have the machine room and the cooking cavity 11 be partitioned from each other. The magnetron generates microwaves which cook the food, the high-tension transformer applies a high voltage to the magnetron, and the cooling fan generates forced air currents to cool the devices inside the machine room.

A control panel 12 having a plurality of control buttons, which allow a user to control operations of the microwave oven, is provided on a front wall of the cabinet 10 at a position corresponding to a front end of the machine room.

The cooking cavity 11 is defined in the cabinet 10 so as to have an opening at its front. A turntable-type cooking tray 13 is installed in the cooking cavity 11 to seat the food thereon. The cooking tray 13 may be rotatable so as to uniformly cook the food in the cooking cavity 11. A first door 20 is provided at the opening of the cooking cavity 11 so as to open and close the opening of the cooking cavity 11.

The first door 20 is hinged to a side edge of a front of the cabinet 10 so as to have the first door 20 be rotatable to the left and right around the hinges to open and close the opening of the cooking cavity 11. The first door 20 is designed so as to primarily prevent a leakage of the microwaves from the cooking cavity 11 through a junction of the cabinet 10 and the first door 20. A first translucent door screen 21 is set in a central area of the first door 20, and allows a user to check the state of the food in the cooking cavity 11.

A second door 30 is mounted to the cabinet 10 so as to cover and uncover the first door 20 at a position in front of the first door 20. The second door 30 secondarily intercepts the microwaves which have leaked from the cooking cavity 11 through the junction of the cabinet 10 and the first door 20.

The second door 30, for example, is smoothly curved so as to cover a front and a top of the first door 20. The second door 30 comprises an upper door part 31 which is hinged to a top edge of the cabinet 10, and a lower door part 32 which is hinged to a lower edge of the cabinet 10. The upper and lower door parts 31 and 32 of the second door 30 are fitted together tightly at a position in front of the first door 20, thus covering the front of the first door 20.

The upper door part 31 of the second door 30 is designed so as to cover both the top edge of the first door 20 and a part of an upper portion of the first door 20. The upper door part 31 intercepts the microwaves which have leaked from the cooking cavity 11 through the junction of the top edge of the first door 20 and a front wall of the cabinet 10. The lower door part 32 of the second door 30 is hinged at a lower edge thereof to a projecting base 14. The projecting base 14 projects forward along a front edge of a bottom of the cabinet 10 to a predetermined length so as to provide a base to mount the lower door part 32 to the cabinet 10.

The upper and lower door parts 31 and 32 of the second door 30 are designed so as to be wider than the first door 20 by a predetermined width, allowing the second door 30 to effectively intercept the microwaves which have leaked from the cooking cavity 11 through the junctions of both side edges of the first door 20 and the front wall of the cabinet 10.

A second translucent door screen 33 is set in a central area of the lower door part 32 of the second door 30, and allows a user to check the state of the food in the cooking cavity 11.

While the first door 20 is rotatably hinged to the front of the cabinet 10 to rotate left and right to open and close the cooking cavity 11, and the second door 30 is rotatably hinged to the cabinet 10 to rotate upward and downward, it should be understood that the first door 20 may be hinged to the cabinet 10 to rotate upward and downward, and the second door 30 may be hinged to the cabinet 10 to rotate left and right. That is, other arrangements of the first door 20 and the second door 30 are possible with respect to the cabinet 10 without departing from the scope and spirit of the invention.

Figure 3:
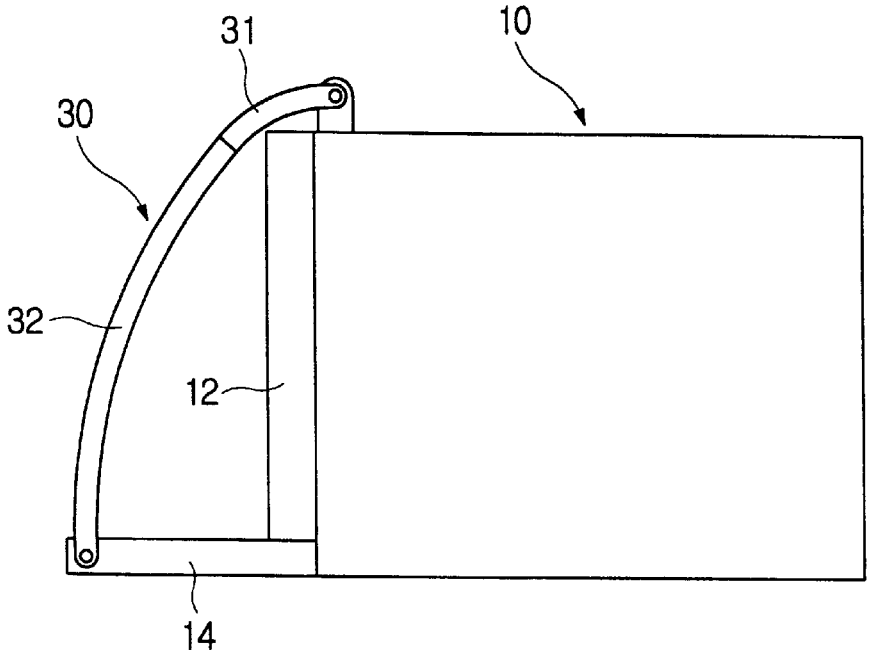
FIG. 3 is a side view of the microwave oven shown in FIG. 2.

An operation and effect of the microwave oven shown in FIGS. 2 and 3 will be described herein below.

To cook food by using the microwave oven, the food is laid on the cooking tray 13 in the cooking cavity 11, and, thereafter, the first door 20 is rotated to close the cooking cavity 11. Afterwards, the upper and lower door parts 31 and 32 of the second door 30 are rotated downward and upward to be fitted tightly at a position in front of the first door 20, thus covering the front of the first door 20. Where a cooking operation of the microwave oven is started, the magnetron installed in the machine room generates the microwaves which are radiated into the cooking cavity 11 to cook the food.

During the cooking operation, a very small quantity of the microwaves may leak from the cooking cavity 11 through upper, lower and both side gaps between the first door 20 and a front wall of the cabinet 10.

In such a case, the second door 30 which covers a top and the front of the first door 20 effectively intercepts the microwaves that have leaked from the cooking cavity 11 through the gaps between the first door 20 and the front wall of the cabinet 10.

As described above, the present invention provides a microwave oven having a second door which covers and uncovers a top and a front of a first door. The first door primarily prevents a leakage of microwaves from the cooking cavity through a junction of a cabinet and the first door. The second door intercepts the microwaves which have leaked from the cooking cavity through the junction of the cabinet and the first door. Therefore, the microwave oven of the present invention more effectively prevents the microwaves from leaking forward from the cooking cavity and reaching an area in front of the microwave oven, where a user may be present during a cooking operation.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. A microwave oven comprising:

a heating unit to cook food;

a cabinet which establishes an appearance of the microwave oven; and a cooking cavity which is defined in the cabinet and includes an opening at a front thereof, wherein the cabinet includes:

a first door which opens and closes the opening of the cooking cavity, and a second door which is installed at a position in front of the first door, and covers and uncovers the front of the first door.

2. The microwave oven according to claim 1, wherein:

the first door is rotatably hinged to a side edge of the cabinet so as to rotate left and right to open and close the opening of the cooking cavity, and the second door is rotatable upward and downward to cover and uncover the front of the first door.

3. The microwave oven according to claim 2, wherein the second door comprises:

an upper door part hinged to an upper portion of the cabinet; and a lower door part hinged to a lower portion of the cabinet, wherein the upper and lower door parts of the second door are fitted together or separated from each other to cover or uncover the front of the first door.

4. The microwave oven according to claim 3, wherein:

the cabinet further includes a projecting base which projects from a lower portion of the cabinet, the upper door part of the second door covers both a top portion of the first door and an upper portion of the front of the cooking cavity, and the lower door part of the second door is hinged to the projecting base of the cabinet.

5. The microwave oven according to claim 1, wherein the second door is wider than the first door by a predetermined width, and is curved in a vertical direction with respect to a base of the cabinet to cover both a front portion and an upper portion of the first door.

6. The microwave oven according to claim 1, wherein the first and second doors include a translucent door screen at corresponding central areas of the first and second doors.

7. The microwave oven according to claim 1, wherein the oven is a wall-mountable microwave oven.

8. The microwave oven according to claim 1, wherein the heating unit includes a magnetron which generates microwaves to cook the food.

9. The microwave oven according to claim 8, wherein:

the first door primarily prevents a leakage of the microwaves from the cooking cavity, and the second door secondarily intercepts the microwaves which have leaked from the cooking cavity through a gap between the cabinet and the first door.

10. A cooking apparatus comprising:

a cabinet which establishes an outer appearance of the cooking apparatus;

a heating unit including a magnetron which generates microwaves to cook food;

a cooking cavity having an opening for receiving the food therein, wherein the cabinet includes:

a door which opens and closes the opening of the cooking cavity, and a shielding unit which retractably covers a front area of the door and intercepts the microwaves which have leaked from the cooking cavity through a gap between the cabinet and the door.

11. The cooking apparatus according to claim 10, wherein the door and the shielding unit are rotatably and retractably hinged to corresponding areas of the cabinet to open and close the opening, and cover and uncover the front area of the door, respectively.

12. The cooking apparatus according to claim 11, wherein the shielding unit is wider than the door by a predetermined width and is curved in a vertical direction to cover the front area and an upper portion of the door.

13. The cooking apparatus according to claim 12, wherein the shielding unit comprises:

an upper panel portion hinged to an upper portion of the cabinet; and a lower panel portion hinged to a lower portion of the cabinet, wherein the upper and lower panel portions are retracted back and forth to uncover and cover the front area of the door.

14. The cooking apparatus according to claim 13, wherein the door and the lower panel portion of the shielding unit include a translucent door screen at corresponding areas of the door and the lower panel portion.

15. The cooking apparatus according to claim 14, wherein:

the door primarily intercepts a leakage of the microwaves from the cooking cavity, and the shielding unit secondarily intercepts the microwaves which have leaked from the cooking cavity.

16. The cooking apparatus according to claim 15, wherein the cooking apparatus is a microwave oven.

17. A cooking apparatus comprising:

a cabinet which establishes an appearance of the cooking apparatus;

a heating unit to cook food;

a cooking cavity having an opening for receiving the food therein, wherein the cabinet includes:

a first door which opens and closes the opening, and having a first axis of rotation, and a second door which covers and uncovers the first door, and having a second axis of rotation not parallel to the first axis, wherein the second door intercepts microwaves leaked from the cooking cavity.

18. The cooking apparatus according to claim 17, wherein the first and second axes are perpendicular to each other.

19. The cooking apparatus according to claim 17, wherein the heating unit includes a magnetron which generates the microwaves to cook the food.

20. The cooking apparatus according to claim 17, wherein:

the first door primarily intercepts a leakage of the microwaves from the cooking cavity, and the second door secondarily intercepts the microwaves which have leaked from the cooking cavity.

* * * * *